United States Patent [19]

Williams et al.

[11] Patent Number: 4,833,849

[45] Date of Patent: May 30, 1989

[54] BUILDING ENCLOSURE ASSEMBLIES

[76] Inventors: Mark F. Williams; Barbara L. Williams, both of 945 Tennis Ave., Maple Glen, Pa. 19002

[21] Appl. No.: 206,885

[22] Filed: Jun. 15, 1988

[51] Int. Cl.[4] ..... E04B 2/30

[52] U.S. Cl. ..... 52/281; 52/481; 52/586

[58] Field of Search ..... 52/281, 481, 586

[56] References Cited

U.S. PATENT DOCUMENTS

| | | | |
|---|---|---|---|
| 3,465,487 | 9/1969 | Fatosme | 52/481 |
| 4,255,910 | 3/1981 | Wendt | 52/481 |
| 4,408,427 | 10/1983 | Zilch | 52/481 |

*Primary Examiner*—David A. Scherbel
*Assistant Examiner*—Jerrold D. Johnson
*Attorney, Agent, or Firm*—George Tarnowski

[57] ABSTRACT

There are disclosed building enclosure assemblies consisting of gypsum-based panel members, a support means and a fire-resistant spline, for the construction of fixed or demountable, full or partial, interior or exterior walls, ceilings and floorings, which can meet code-mandated fire-rating and wind-loading requirements, and in which differently sized and shaped panel members can be articulated to one another through the cooperative assembly of the panel members with the support means and spline.

6 Claims, 12 Drawing Sheets

BUILDING ENCLOSURE ASSEMBLIES

This invention relates to building enclosure assemblies, fixed or demountable, full or partial height, for use in interior and exterior applications, having improved fire resistance characteristics and having the hitherto unobtainable capability of providing a variety of architecturally aesthetic constructs. Building enclosures such as hollow walls, which utilize metal studs that interlock with kerfs in the edge of wallboard are known in the art. The wallboards are usually gypsum sheets with an appropriate surface finish. Wall partitions which are readily assembled and disassembled are referred to as demountable walls and structures of this type have been described in U.S. Pat. Nos. 2,154,520; 3,027,605; 3,712,015; 3,729,883; 3,732,657; 3,908,328; 3,998,027 and 4,312,158. Wall structures of this type usually involve the use of a metal stud which is generally H-shaped and is so configured as to have projections formed thereon which fit into a kerf provided along the adjacent edge of adjacent panels. The sequential fitting of panels edge to edge via the projection/kerf interfitting results in the certain of a partition.

One of the problems inherent in the hitherto known partition system is that the components do not allow for the construction of other than a partition or wall comprised of a series of identically-sized panels fitted edge to edge and disposed between ceiling and floor, without variation as to size or juxtaposition of the individual panels. This creates a "monolithic" appearance to offer a range of visual appearances while unified within one system. Although functional enclosure assemblied, in both practical effect and visual appearance, have been, are and continue to be used, especially in large corporate settings, there is a definite and well-defined need for enclosure assemblies which have the practical effect of providing enclosures that delimit defined spaces and areas while at the same time offering the user and designer more visual choices. This is all the more so, when these goals can be readily accomplished using a minimum of labor, with the economical usage of standardized materials that are factory manufactured with a high level of quality control.

In addition to the aesthetic considerations, the ideal building enclosure assemblies must meet certain safety requirements (especially fire ratings and wind loading), have the flexibility to be readily demountable for relocation and reassembly, as well as to allow for easy access to utility service distribution equipment contained within or behind the enclosure assemblies, such as for example electrical, communications and data processing wiring.

The conventional building systems generally utilize plaster wallboard panels because of considerations such as cost of manufacture, ease of construction, standardization in the industry, and so forth. But while plaster wallboard panels are substantially noncombustible, if sufficient heat is transmitted from the fire-exposed side to the unexposed side of the partition, the partition can fail to resist the spread of fire, heat or smoke. Standards have been developed to determine if the particular partition structure provides sufficient fire resistance to be termed "fire-rated." Such tests involve subjecting the partition to fire heat conditions on one side for predetermined periods of time. The ability of the partition to withstand such heat without exceeding specified temperatures on the exposed side determines if the partition is satisfactory from the standpoint of resisting the spread of fire. Thereafter the partition is usually subjected to a hose stream test to simulate a condition which occurs when a fire is extinguished. In some situations, the fire rating requirements are even more stringent than those described above. Elevator shaft walls require, for example, at least a 2-hour rating. Where the wall system is "unbalanced," increasingly, code enforcement organizations are requiring that the rating be achieved from both sides of the wall. To pass such tests, heat transfer via the metal studs used in the construction of such walls must be substantially reduced.

When gypsum board is subjected to a fire environment, the boards tend to shrink 1% or more. such shrinkage tends to open the joint between the panels, which in turn exposes the metal frame structure. This can cause unacceptable high temperatures to be transmitted through to the unexposed side of the wall. Further, if the metal studs are excessively heated along one side, a deflection toward the fire develops, which increases the amount of framing exposed to the fire and causes a straining of the weakened gypsum board, often to the point of failure and collapse of the fire side board and rapid deterioration of the total wall assembly.

One attempt to meet this problem is that described in U.S. Pat. No. 4,312,158, in which a demountable partition structure constructed of plasterboard panels further utilizes plasterboard material assembled into a "core" inside a hollow wall created by the partition structure, where the H-shaped metal studs used to support the panels are so arranged that the insulating central "core" is disposed between the metal studs. The insulation material of the core of the stud functions to bridge the joint when shrinkage occurs to provide continuing insulation of the metal of the stud and to provide a seal across the joint which resists penetration of heat or water into the partition when the partition is exposed to the excessive heats which occur during a fire and when water is used to extinguish the fire. However, this type of solution to the problem of fire resistance is more labor intensive than the conventional partition systems, and this factor together with the cost of additional plasterboard for the core material makes this system too costly for typical partition installations. Also, the nature of the system described in U.S. Pat. No. 4,312,158 does not permit for variation of articulation of the panels, as to panel size or juxtaposition.

Wind loading is another consideration in building enclosure assemblies, especially where the partitions are used to enclose shafts such as air return shafts, elevator shafts and stairwell shafts commonly found in multistory buildings such as offices and high-rise apartments. Destructive wind loading is of particular concern where the shaft is an air return shaft or an elevator shaft, where pressures or vacuums are developed which load the shaft wall up to 15 pounds per square foot in excess of atmospheric pressure.

Accordingly, improvement in the strength of any partition system is as important as an improvement in its fire-retardant properties.

It is, therefore, an object of the invention to provide building enclosure assemblies for the construction of interior walls, floors and ceilings and exterior walls which meet code mandated fire and wind loads, and which permit ready access to the electrical/telephone/-communication/data wiring systems contained within said assemblies.

It is a further object of the invention to provide building enclosure assemblies which have improved safety characateristics and which at the same time have the flexibilty to allow the articulation of differently sized and shaped panels to achieve esthetically pleasing enclosures.

It is an additional object of the invention to provide building enclosure assemblies which are uniquely adapted to the use of a novel form of gypsum-based wallboard, such that the system is inexpensive, lightweight, easily constructed and can be either permanent or demountable.

Other objects and advantages will become apparent upon reference to the drawings and detailed description.

According to the invention, there is provided a building enclosure assembly comprising, in combination, a plurality of gypsum-based floor, wall or ceiling panel members with a shouldered groove of stepped cross-sectional profile longitudinally rabbeted into at least one edge of said panel member, said shouldered groove comprising two distinct groove sections of distinct depths and widths, wherein a first groove section is of shallower depth and narrower width than a second groove section which is contiguous with said first groove section; a generally channel-shaped support means having a web portion and side portions, with a substantially L-shaped flange member, comprised of a leg and a foot, extending by said leg from a side portion of said support means and terminating in the foot which is substantially perpendicularly disposed relative to the web portion of the support means; and a fire-resistant spline; where adjacent pairs of said panel members are articulated by the inter-engagement of said L-shaped flange member and said spline with said shouldered grooves in the edges of adjacent panel members, the foot of said L-shaped flange member nesting into the first groove section and being retained therein by the nesting of a portion of the spline into the second groove section, whereby said spline completely spans over the foot of said L-shaped flange member in its position in the first groove section and a second panel member is articulated adjacent said first member by the nesting of the remaining portion of said spline into the second groove section in the edge of said second panel member.

The building enclosure assembly just described can be used for the construction of hollow partition structures, such as walls, which serve to delimit open spaces. In such constructions, the support means utilized will conventionally be metallic studs having the L-shaped flange member on which are mounted, in conjunction with the splines, the gypsum-based panel members of the invention, this assembly forming one half of a hollow partition wall structure comprised of two opposite and parallel spaced-apart walls comprised of panel members. The L-shaped flange member of the studs not only confers stiffness to the stud but also provides a back-up to the edges of the panel members, thereby resisting lateral loads imposed against the panel member joints. Further, when the enclosure assemblies of the invention are used to construct hollow wall partitions, the offsetting of the panel joints in the first wall, relative to the joints in the second opposite and parallel wall by the appropriate orientation of the L-flange members of the support means prevents the alignment of the panel member articulation joints of the opposite walls, reducing the potential for the direct and unhindered access of water or fire across the hollow wall via the joints. Utilizing the support means of the invention, it is also possible to construct a wall against a pre-existing structure against which the support means can be fixedly mounted. The latter situation arises when the invention is used for the construction of a new wall over an existing wall structure, as well as in the construction of ceilings and floors.

By virtue of the co-action of the panel members and the spline of the invention, the building enclosures of the invention are able to conform to the requirements of code-mandated fire- and wind-ratings for building enclosures. Moreover, the enclosures of the invention can be permanent or demountable, and can be used for the construction of permanent exterior walls, both bearing and non-bearing, when clad to meet the requirements of exterior wall construction.

BRIEF DESCRIPTION OF THE DRAWINGS In the drawings.

Figure 1:
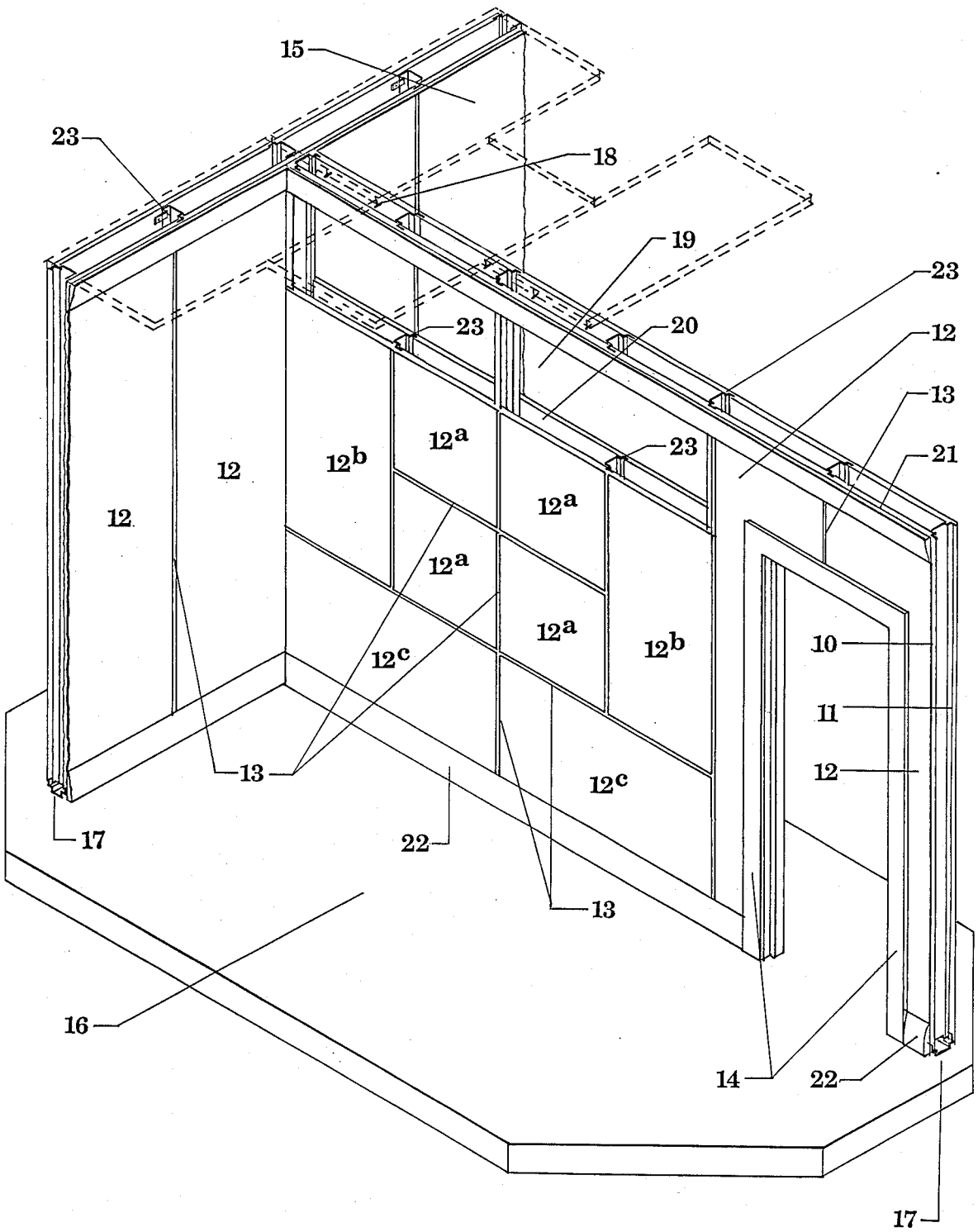
FIG. 1 is a fragmentary, axonometric projection of hollow interior wall installed in accordance with the present invention.

FIG. 1 is a fragmentary, axonometric projection of typical installation of a hollow interior wall in accordance with the invention. This particular installation illustrates the versatility of the system of the invention in creating an effect other than the conventional full height floor-to-ceiling panelling. Thus, in the presently illustrated installation, parallel rows 10 and 11 of gypsum-based panels 12, form a wall in which adjacent panels abut along joints 13 to extend between a floor structure 16 and ceiling structure 15. The first two panels 12 surrounding door frame 14 are typical floor-to-ceiling height panels, such as are conventional in the art. The remaining panels 12 are illustrative of the variety of panel articulations that are possible with the system of the invention. Thus, it is possible to achieve a wainscotting effect, as exemplified by panels $12^c$, on top of which is formed a more intricate wall section consisting of small square side panel sections $12^1$ which surround two adjacent vertically rectangular panels $12^b$. The panels $12^a$, $12^b$ and $12^c$ can be covered with a variety of surface material in a variety of textures and colors to achieve a more individualized and aesthetically more pleasing appearance than that obtained by the conventional floor-tocieling adjacent vertical panel sections, such as 12. It is also possible to create additional design features which are adaptable to contemporary architectural trends. Thus, it is possible to create a sidelight or a clerestory with frame and glazing at sections 19 and 20 disposed between the ceiling 15 and the tops of panel sections $12^1$ and $12^b$. The lower edges of panels 12 and $12^c$ are secured to a section of the support means of the invention, which in this instance also serves as a floor track 17 and the upper edges to panels 12 and windows 19 and 20 are secured to a ceiling track 18, as for example, with screws. Optional ceiling trim members 21 and baseboard trim members 22 extending along the length of the ceiling and floor, respectively, may be provided. A plurality of support means 23 are positioned between the two rows 10 and 11 as more fully described hereinbelow.

Figure 2:
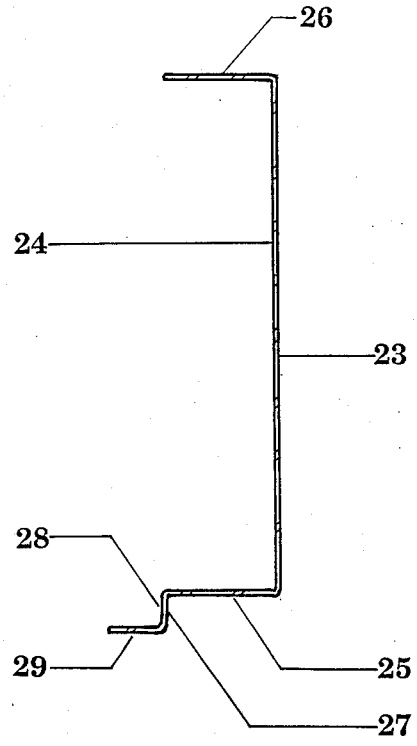
FIG. 2 is a cross-section illustrating the structure of the support means of the invention.
Figure 3:
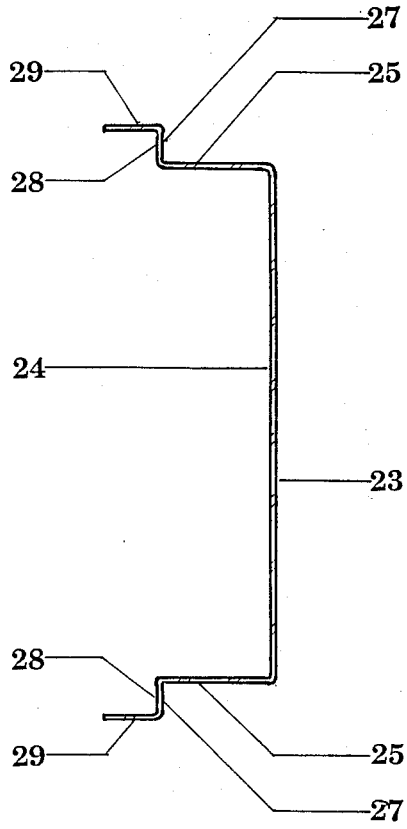
FIG. 3 is a cross-section illustrating the structure of an alternative embodiment of the support means illustrated in FIG. 2.

Referring now to the remaining Figures, the detailed structure of the support means, spline and panel interrelationships is illustrated, especially in FIGS. 2, 3, 4, 5 and 6, in which numbers identical to those used in other Figures refer to identical features. Thus, in FIG. 2, substantially channel-shaped support means 23, comprise a web 24 and side portions 25 and 26. Extending from side portion 25 is an L-shaped flange member 27 comprised of leg 28 and foot 29, the latter being substantially perpendicular to the web portion 24. In FIG. 2, side portion 26 defines a simple flange which is a perpendicular extension of web portion 24. In FIG. 3, there is shown an alternate embodiment of the support means of FIG. 2, in which the flange 26 is modified to form another side portion 25 and L-shaped flange members 27, symmetrical with the one illustrated in FIG. 2.

Figure 4:
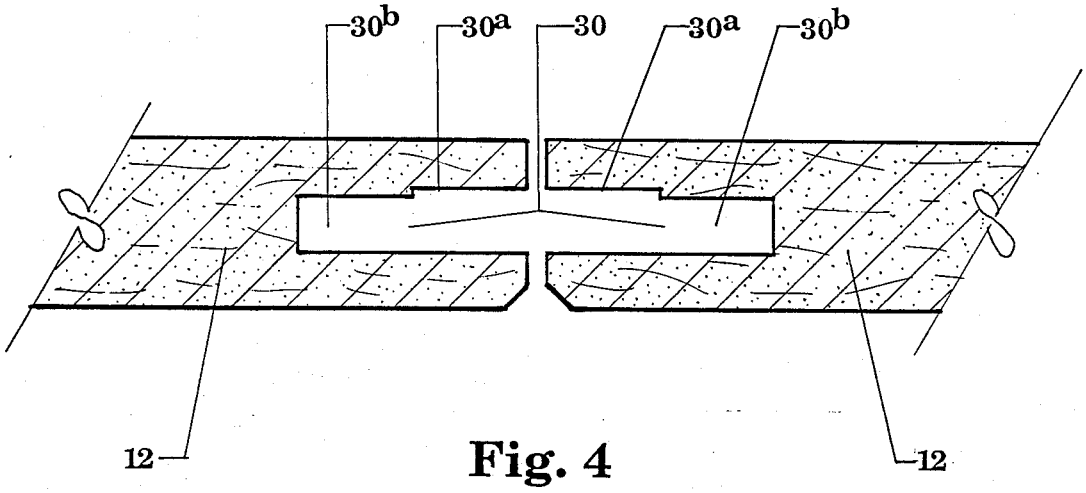
FIG. 4 is an enlarged cross-section illustrating the shouldered groove of stepped cross-sectional profile which is formed in the edge of the panel members of the invention.
Figure 5:
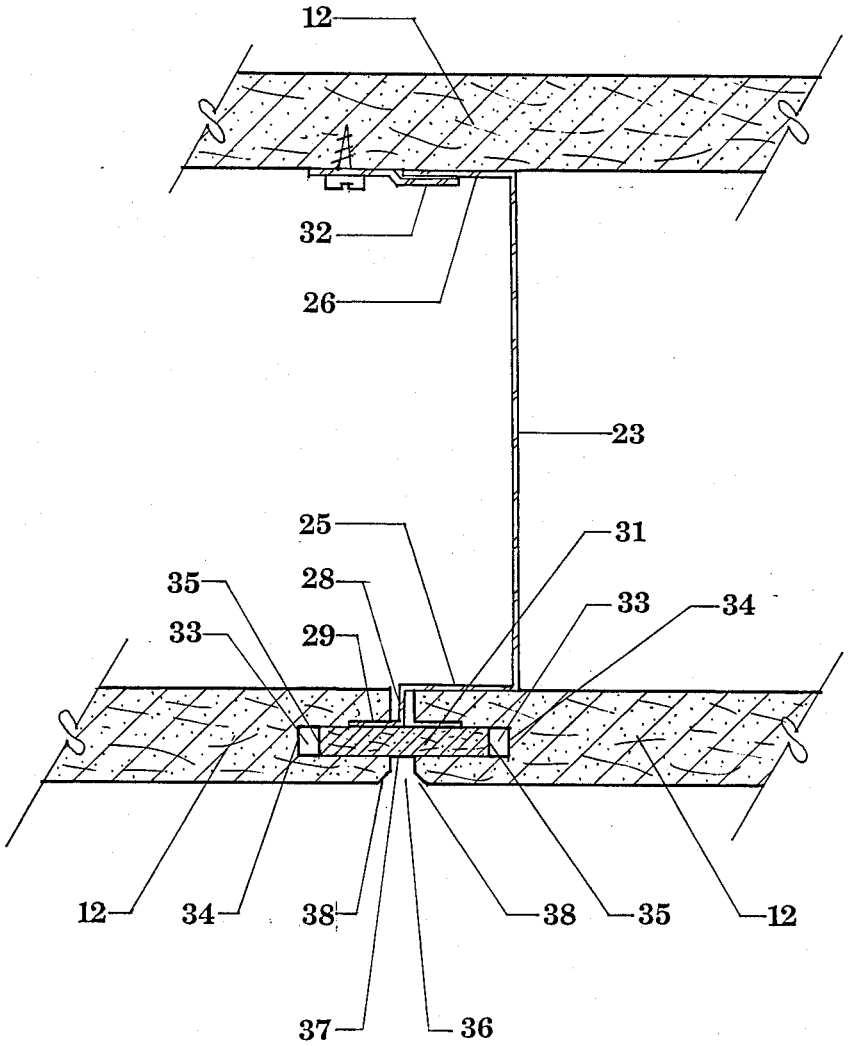
FIG. 5 is an enlarged cross-section illustrating the structure of the support means and its co-operation with the other elements of the invention.
Figure 6:
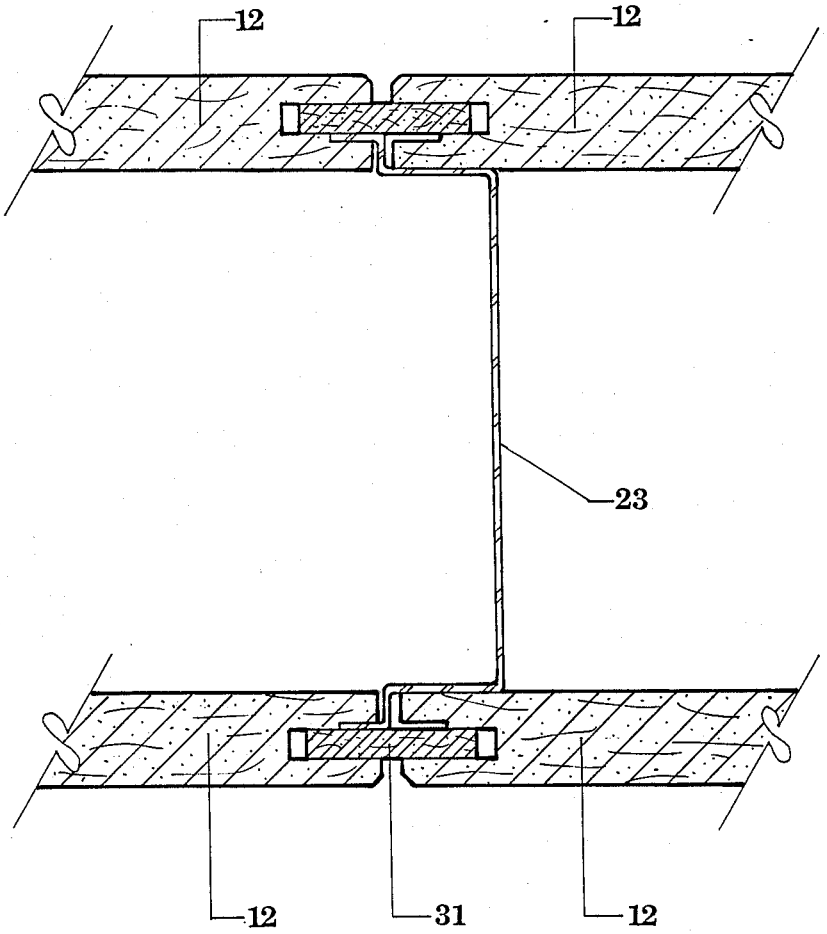
FIG. 6 is an enlarged cross-section illustrating the structure of the alternative support means of FIG. 3 and its co-operation with other elements of the invention.

FIG. 4 illustrates the configuration of grooves 30 formed in panel members 12 which cooperate with the support members and spline of the invention. Panel members 12 have longitudinally rabbeted into at least one of their edges a shouldered groove 30, which in cross-sectional profile presents a stepped groove comprised of two stepped groove sections $30^a$ and $30^b$. The first groove $30^1$ is of a shallower depth and narrower width than second groove $30^b$. The first groove section $30^a$ is of such dimension as to nestingly receive the foot 29 of L-shaped flange member 27 of support means 23, while second groove section $30^b$ is of such dimension as to nestingly receive a portion f the spline of the invention which will be described hereinafter. Referring now to FIG. 5, as well as referring back to FIG. 4, there is illustrated an enlarged crosssection view of a hollow wall comprised of opposite and parallel rows of articulated panel members 12, which are mounted on and secured to each other via the support means 23 and spline 31. According to the invention, the foot 29 of L-shaped flange member 27 is nested into groove section $30^a$ of shouldered groove 30, and then spline 31 is nested into the second groove section $30^b$, securing foot 29 into its position in groove section $30^a$, with spline 31, as a result of its position in groove section $30^b$, completely spanning over the foot 29. The other side of support member 23 is retained against panel member 12 by holdfast 32 which secures side portion 26 thereto. In an alternative embodiment, illustrated in FIG. 6, the support means 23 illustrated in FIG. 3 is used in place of that illustrated in FIG. 2. By use of the modified support means of FIG. 3, the hollow wall constructed therewith is symmetrical, whereby the joints between panel members in one wall are in alignment with those in the opposite wall.

The support means, panel member with shouldered groove and spline of the invention, in their co-operative aspect, provide the key to the fire-resistance capabilities of the building enclosure assemblies of the invention. The panel members, which are made of a gypsum-based material, are highly fire-retardant, so that any enclosure, be it a wall, celing or floor, constructed of the enclosure assembly of the invention, will be substantially fire-resistant in its broad surface aspect. The main point at which conventional partition structures fail in the face of a fire is at the joints where adjacent panel members meet. In the enclosure assembly of the invention, the fire-resistant spline forms the primary barrier to the breaching of the wall, ceiling or floor by a fire. The spline, which is made of a suitable fire-resistant material, preferably the same fire-resistant gypsum-based material of which the panel members of the invention are formed, presents a uniform fire-resistant surface of any fire directed against it. As the heat intensity of the fire causes the panel member material to contract and the joint between adjacent panel members to open, the shrinkage merely exposes more of the surface of the fire-resistant spline to the fire. Referring back to FIG. 5, the fire-resistant effect of the spline 31 is enhanced by the presence of airspace 33 created between endwall 34 of the second groove section and the edge 35 of spline 31, as the heat of a fire is less likely to be communicated around spline 31 via the airspace 33, and support means 23 is completely protected from the direct effects of the heat of a fire directed against an enclosure assembly of the invention. Moreover, the airspace also enhances the acoustical properties of the assemblies of the invention, as sounds are less likely to be communicated across the airspace. Of course, although the airspace is a preferred feature because of its fire-resistance and acoustical property enhancing effects, it is not an absolute requirement, an the building assemblies of the invention in which the spline edge 35 abuts against second groove section endwall 34 possess all the desirable characteristic of the system described hereinbefore.

Yet another aspect of the invention which contributes to the high fire-rating capabilities of the invention is the fact that by the appropriate positioning of the L-flange members of the support means in the erection of a hollow all partition consisting of opposite and parallel walls, the formation of a joint in one wall does not result in the formation of a joint in the opposite wall which would be in direct alignment with the joint in the first wall, i.e., the joints in one wall are staggered relative to the joints in the opposite and parallel wall. This can be more readily appreciated by referring to FIG. 7, where the cutaway perspective view clearly illustrated the way in which a staggered joint is formed in the construction of opposite walls of a hollow partition. This arrangement does not permit the heat of a fire to breach a hollow wall by conduction from one joint, across the support means to an opposite joint, in the event of the failure of the first wall to resist the conduction of the heat of the fire via the support means.

A key feature of the enclosure assembly of the invention is the use of a gypsum-based material for the panel members. The typical gypsum plaster board which is currently the standard material in the construction trade has production and use limitations and disadvantages. The gypsum-based material of the invention, which embraces gypsum fiber board and gypsum particle board, is commercially available and can be used in the invention.

Gypsum particle board is a modification of the gypsum fiber board discussed immediately hereinafter. Its properties are more similar to that of conventional particle board and is therefore more properly to be compared to the latter than to plaster board. It is, however, completely compatible with the methodology and objects of the enclosure assemblies of the invention and thus is to be considered as equally useful for all applications of the invention in which gypsum fiber board is utilized.

Gypsum fiber board is a compressed semi-dry process composition consisting of plaster of paris, waster paper, additives to regulate setting time and water. The finished material is a fire-resistant building board of homogeneous composition having much higher bending strength as compared to conventional plaster board. This is especially true of the length direction bending strength of gypsum fiber board, which is twice that of plaster board. The random orientation and uniform distribution of fiber is gypsum fiber board makes it possible to obtain sharp edges free of defects upon sawing, milling, planing or drilling. Further, the homogeneity allows the boards to be readily sanded and makes them suitable for lamination with plastic sheets or wood veneers. On the other hand, the workability of conventional plaster board is restricted, especially due to the brittleness of the hydrated plaster core an the teasing and stripping properties of the relativly soft outside paper coat of plaster board.

The particular suitability of gypsum-based panel members to the system of the invention can be readily appreciated. Thus, the gypsum fiber panel members are strong enough to be subjected to the various operation which can be used to create the groove in thw edges of the boards as required by the invention. Typical groove forming operations include the milling of the rabbeted groove by mechanical, chemical or electrical means, with groove formation by mechanical milling during the manufacturing process being the most preferred. The groove in question must be easily formed, must be of such dimensions as to accept both the spline and the flange member of the support means of the invention, and the panel edge members defining the groove must be sufficiently strong to resist breakage during formation, shipment or installation. These conditions cannot be met with conventional gypsum board, which cannot be milled, is too weak to support a grove of the dimensions required by the system of the invention and even if such a groove could be formed in the edges of conventional gypsum board, the inherent weakness of the latter would result in breakage during shipment or installation, if not at the groove-forming step. Further, as earlier described, the spline used in the system of the invention can also be formed from gypsum fiber board, so that the completed partition structure of the invention can create a uniform, fire-resistant system which meets all code-mandated fire-rating requirements without the labor intensive, high cost systems taught in the prior art.

The strength of gypsum fiber panel members also permits the invention to be used in those instances in which wind-loading is a factor, for example in partitioning open shafts such as air return shafts, elevator shafts and stairwell shafts, as well as in exterior wall applications, In the latter case, the system of the invention can be used to erect permanent bearing or non-bearing walls where the walls constructed with the system of the invention are clad with suitable building materials to meet all code-mandated requirements.

The support means of the invention is preferentially a metallic stud having a cross-sectional profile as earlier described. While it is also preferred that the support means and thereby the flange member, extend the entire length of a joint between adjacent panel members, the support means can also extend along only a portion of the joint, such that it imparts the necessary support and meets the mounting requirements for any given situation.

Figure 7:
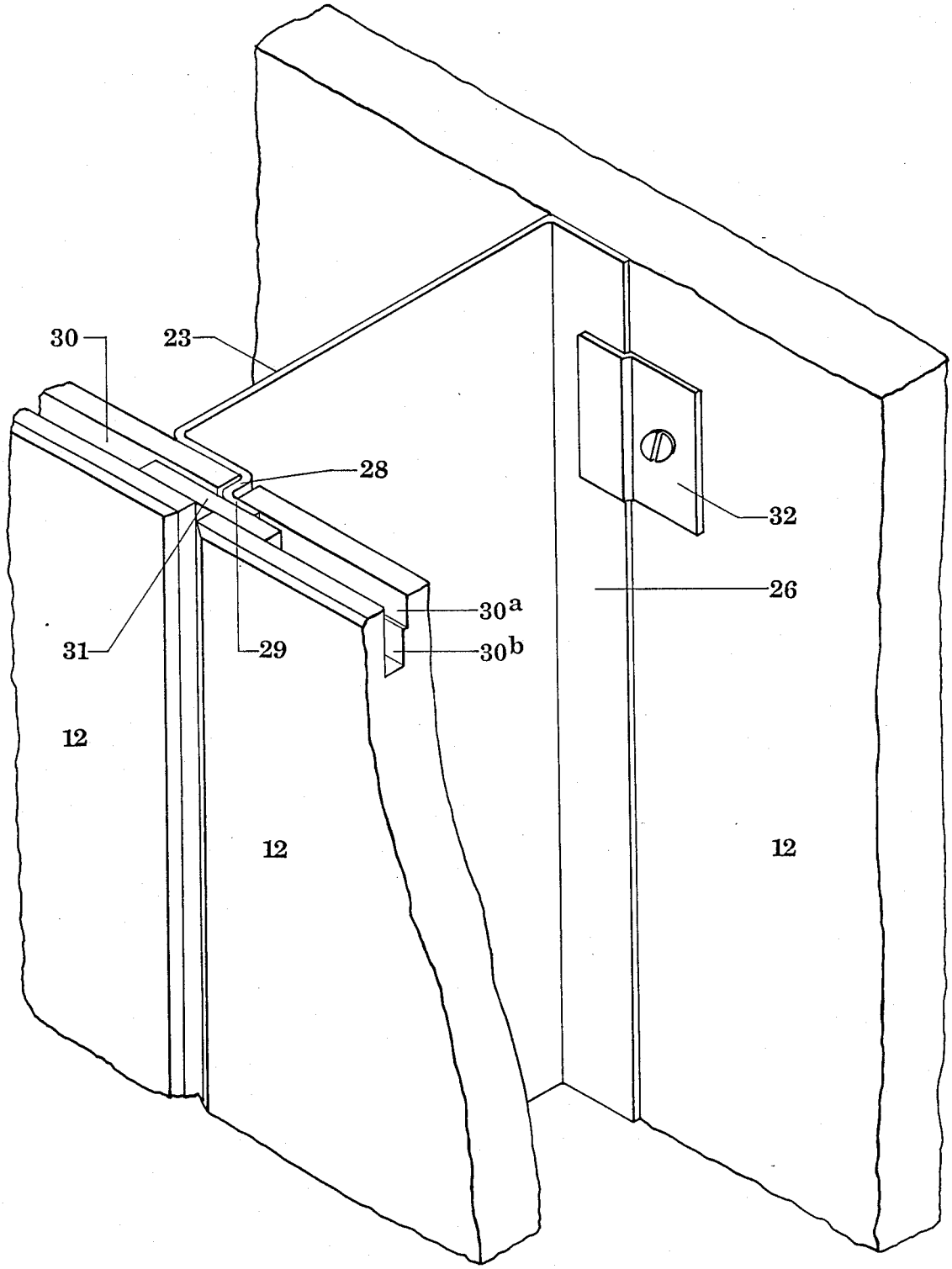
FIG. 7 is a partially cutaway perspective section of a hollow wall partition of the type shown in FIG. 5, illustrating the co-operation of the components of the invention.
Figure 8:
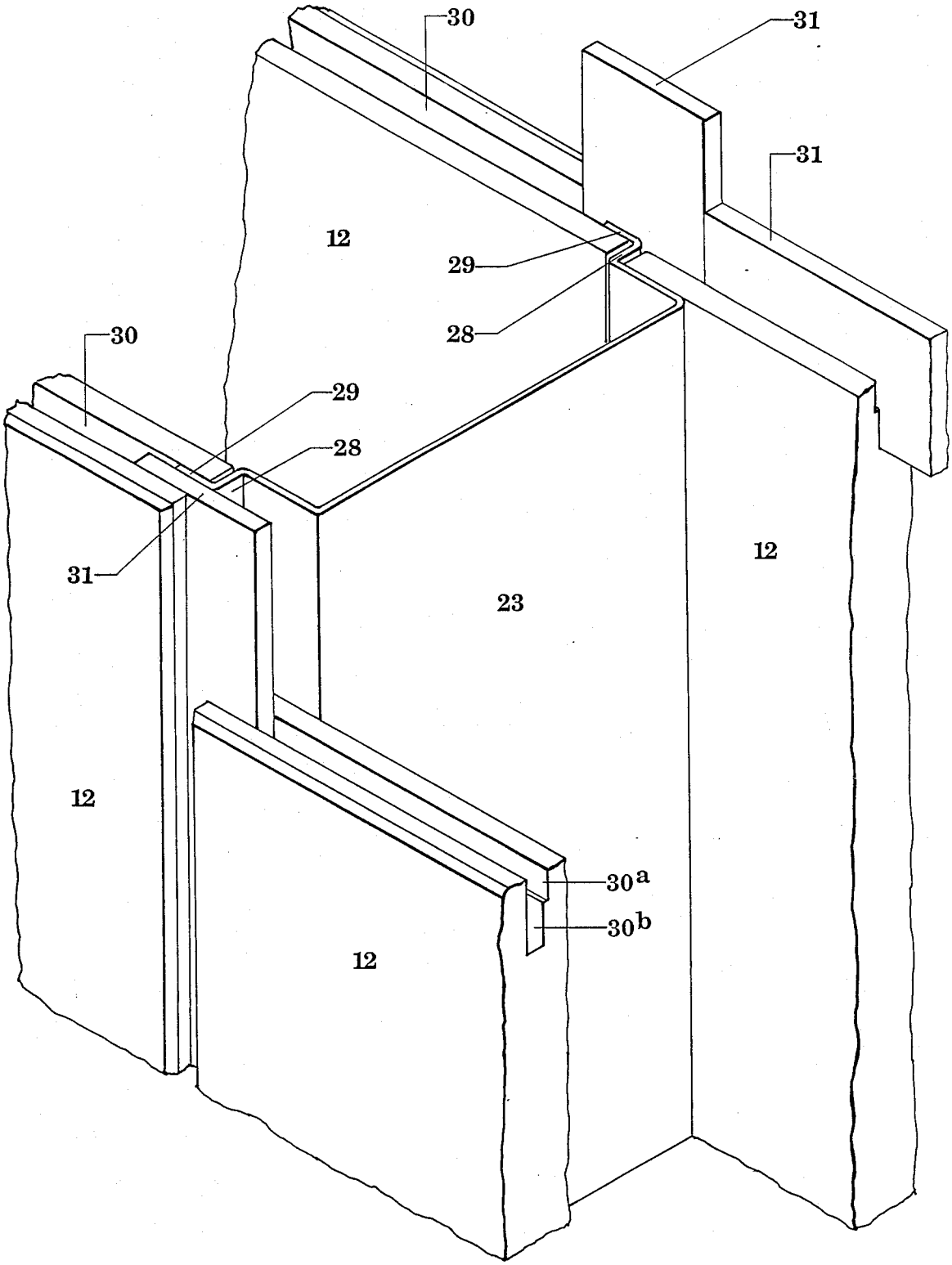
FIG. 8 is also a partially cutaway perspective section of a hollow wall partition of the type shown in FIG. 6.

The construction of a given enclosure assembly proceeds by fitting panel members into support means via the groove-engaging flange member, with adjacent panel members being locked adjacent to each other with the spline. Since the gypsum-based panel members can be manufactured in any desire size and geometric design, and since all board edges can be provided with the shouldered groove hereinbefore illustrated and discussed, the panel members can be fitted and arranged one to the next in any desired pattern. The support means necessary to effect the joining of adjacent panels can be custom cut to any desired length to accommodate the chosen adjacent panel configuration. FIG. 8, which like FIG. 7 is a partially cutaway perspective view, illustrates a section of the enclosure assembly of FIG. 6 demonstrating how the support in any desired pattern. The support means necessary to effect the joining of adjacent panels can be custom cut to any desired length to accommodate the chosen adjacent panel configuration. FIG. 8, which like FIG. 7 is a partially cutaway perspective view, illustrates a section of the enclosure assembly of FIG. 6 demonstrating how the support means, spline and panels of the invention are used to create the wall effect of FIG. 1, where all reference numbers identical to those previously given refer to identical features.

Returning to FIG. 5, it can be seen that the edges of adjacent panels 12 need not abut each other, and that a space 36 can exist between the edges of adjacent panel members 12. In this event, spline 31 can have the outwardly facing surface 37 finished so as to present a decorative aspect adjacent the outwardly facing surfaces of panel members 12. In such cases, the edges of the panels 12 can be chamfered at 38 to provide a decorative aspect to these non-butted edges.

Figure 9:
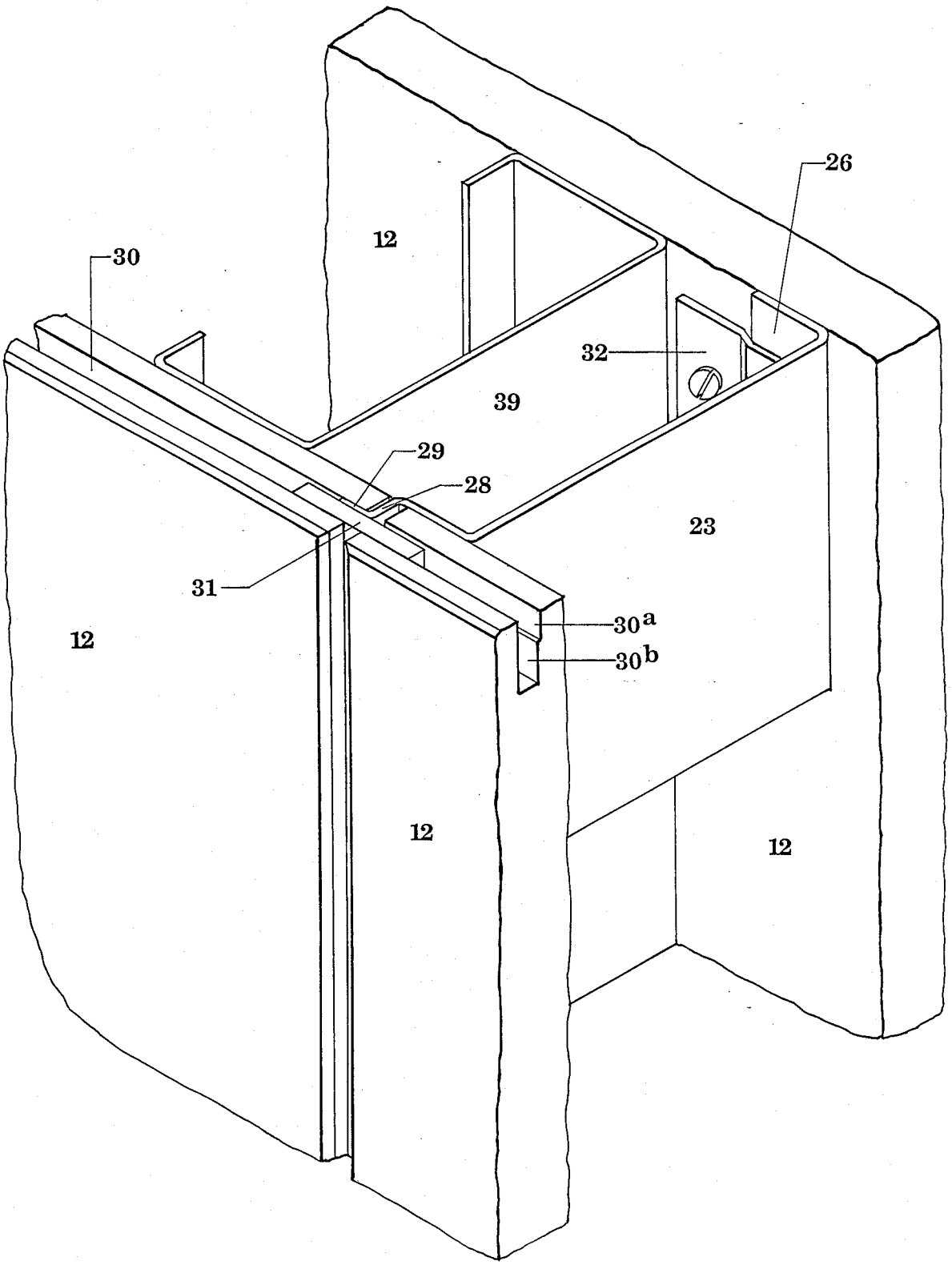
FIG. 9 is a partially cutaway perspective section of a hollow wall partition illustrating the erection of a wall upon pre-existing studs and utilizing the support means of the invention modified into a clip.
Figure 10:
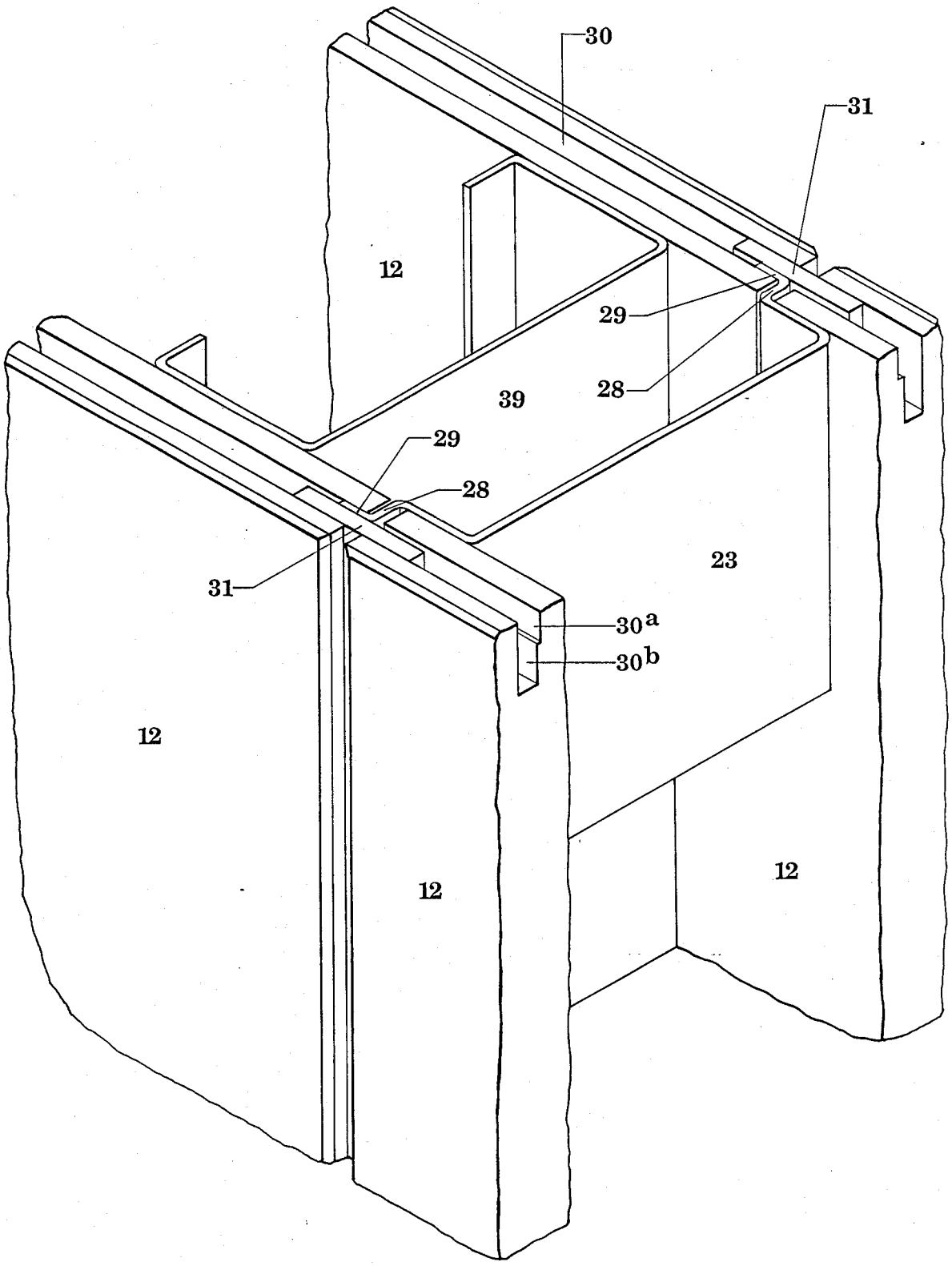
FIG. 10 is a view identical to that of FIG. 9, in which the clip is a modification of the support means illustrated in FIG. 3.

It is also contemplated that the elements of the enclosure assemblies of the invention can be utilized in the construction of hollow wall partitions utilizing preexisting support means. Thus, situations will arise in which existing hollow wall partitions of conventional construction are to be removed or perhaps converted to the enclosure assembly of the invention. In such instances, it is possible that the preexisting construction was carried out using conventional metallic or wooden studs which are fixedly disposed between ceiling and floor. With the use of the elements of the invention, it is possible to erect a new hollow wall partition using the existing studs. this aspect of the invention is illustrated in FIGS. 9 and 10, which are cutaway perspective views of a hollow wall partition, in which the pre-existing stud 39 is retained in situ while the enclosure assembly of the invention is utilized to clad or reclad the existing wall partition. In this case, panel members 12 are mounted as described hereinbefore, utilizing the pre-existing stud 39 as a support means, to form the two opposite and parallel walls of the partition. However, the panel members 12 and the splines 31 are co-operatively associated with a modified invention support means 23, which now functions as a retaining clip to retain the panel members against the pre-existing stud 39. The support means in this aspect has the profile of the embodiment illustrated in FIG. 2 and 3 and is of a length sufficient to exert its retaining effect but not of such length as to run the full floor to ceiling height of the panel members. In actual applications, it may be desirable or necessary to use more than one clip per panel member joint to retain the panel members 12 firmly against the preexisting stud 39. Moreover, if the pre-existing studs 39 do not interfere unduly, it is possible to employ this modified enclosure assembly-clip system to create new hollow wall partitions against pre-existing studs with variations in the articulation of differently sized and shaped panel members to achieve aesthetically pleasing partitions.

Figure 11:
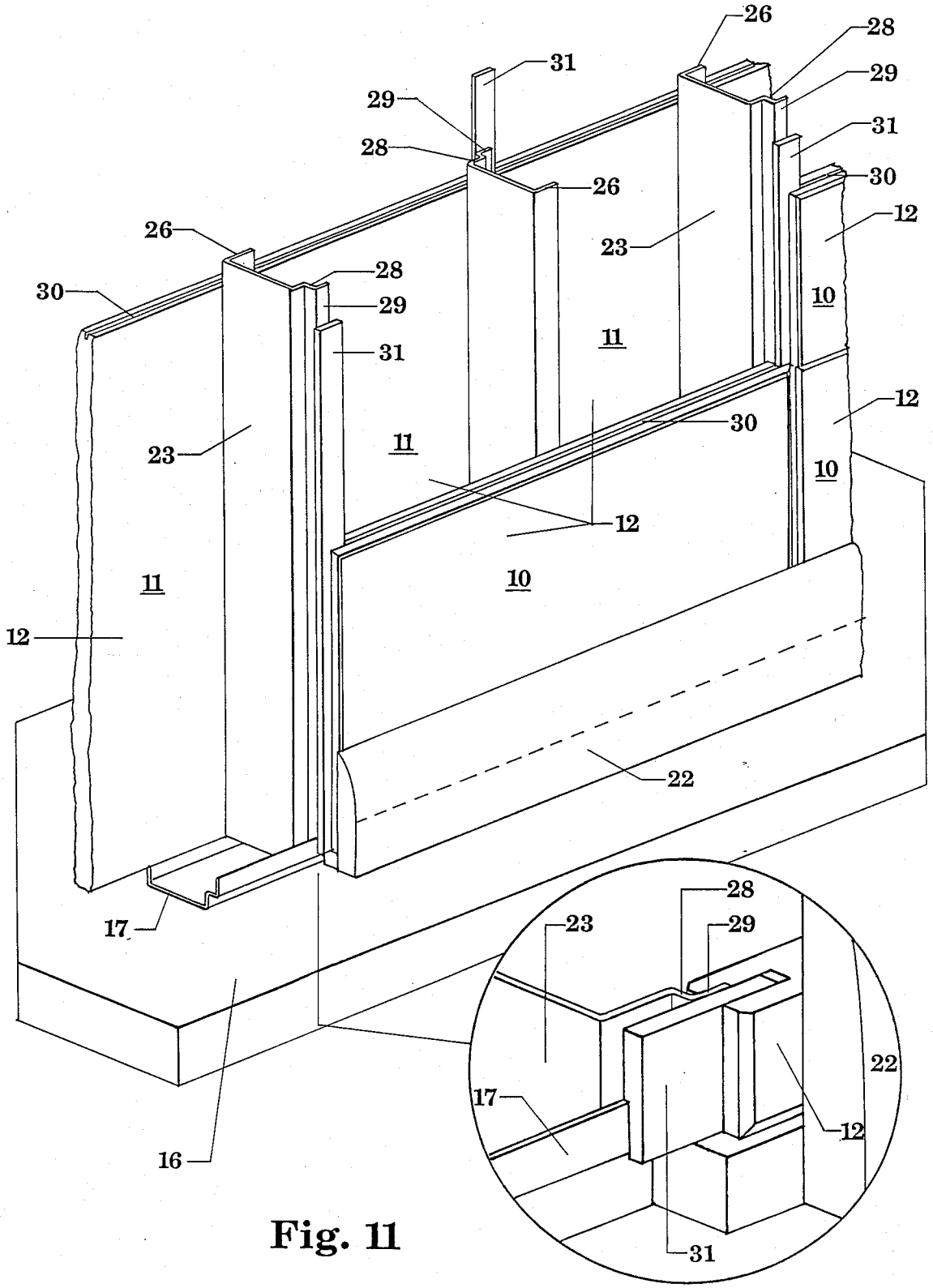
FIG. 11 is a partially cutaway axonometric projection of the base detail of the wall illustrated in FIG. 1, with an enlarged view illustrating the co-operation of the components of the invention at the wall base.
Figure 12:
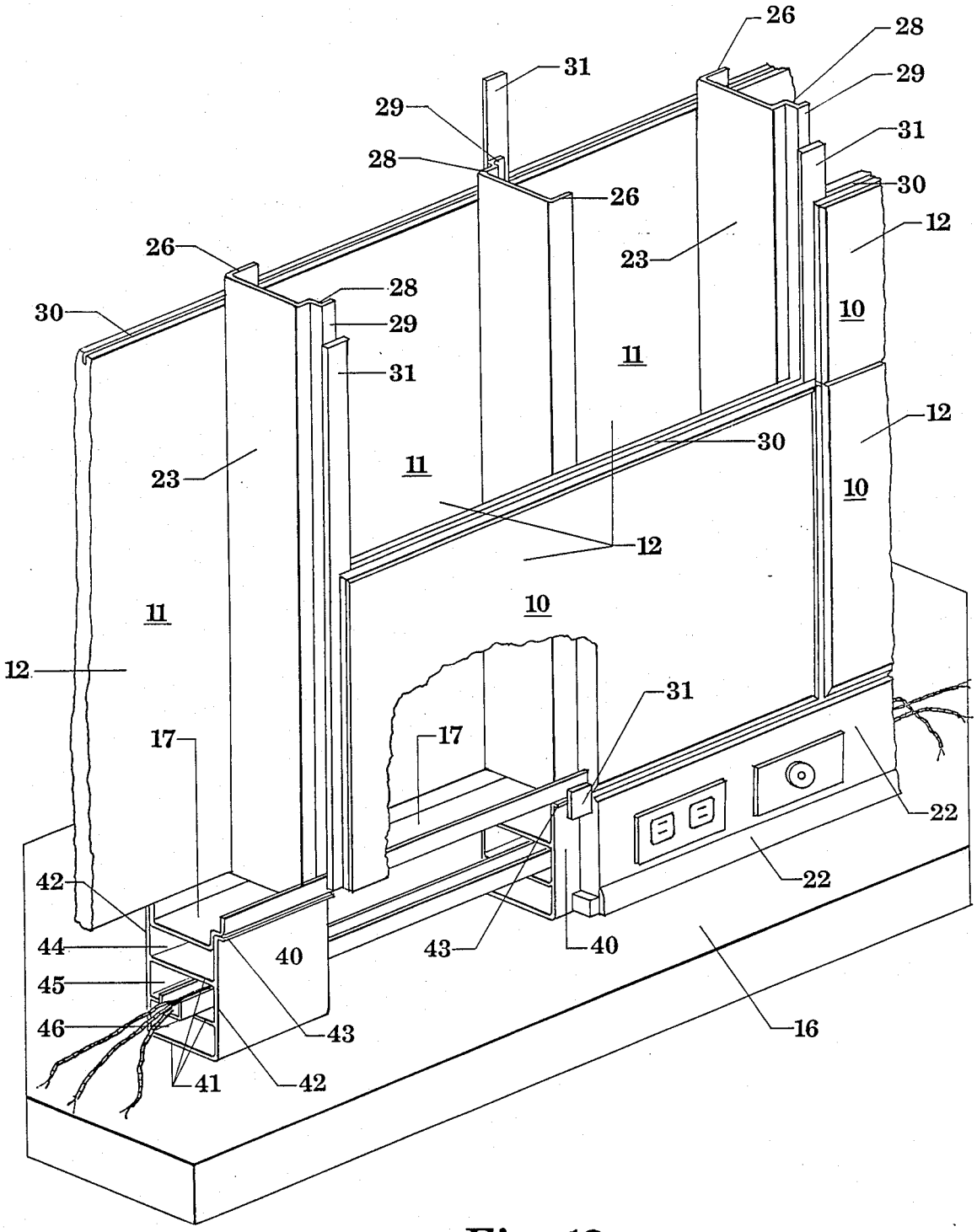
FIG. 12 is a partially cutaway axonometric projection of an alternative base detail to that shown in FIG. 11.

The cooperation of the individual components of the building enclosure assemblies of the invention informing the base detail of the wall illustrated in FIG. 1 is shown in FIG. 11, which also shows an enlarged view illustrating the cooperation of the components of the invention at the wall base, and in FIG. 12, which shows an alternative base detail within the scope of the invention. In this connection, it is to be noted that FIGS. 11 and 12 illustrate the use of the support means 23 of the invention to construct a hollow wall partition in which the two opposite and parallel walls 10 and 11, are composed of differently articulated panel members 12. Thus, while wall 10 has joints formed by the support means 23 at the left and right side of the partial views of FIGS. 11 and 12, th centrally positioned support means forms a joint in wall 11 which does not find its counterpart in wall 10, thus permitting different articulations in the respective walls at these points. All the reference numbers identical to those in previous figures refer to identical features.

Figure 13:
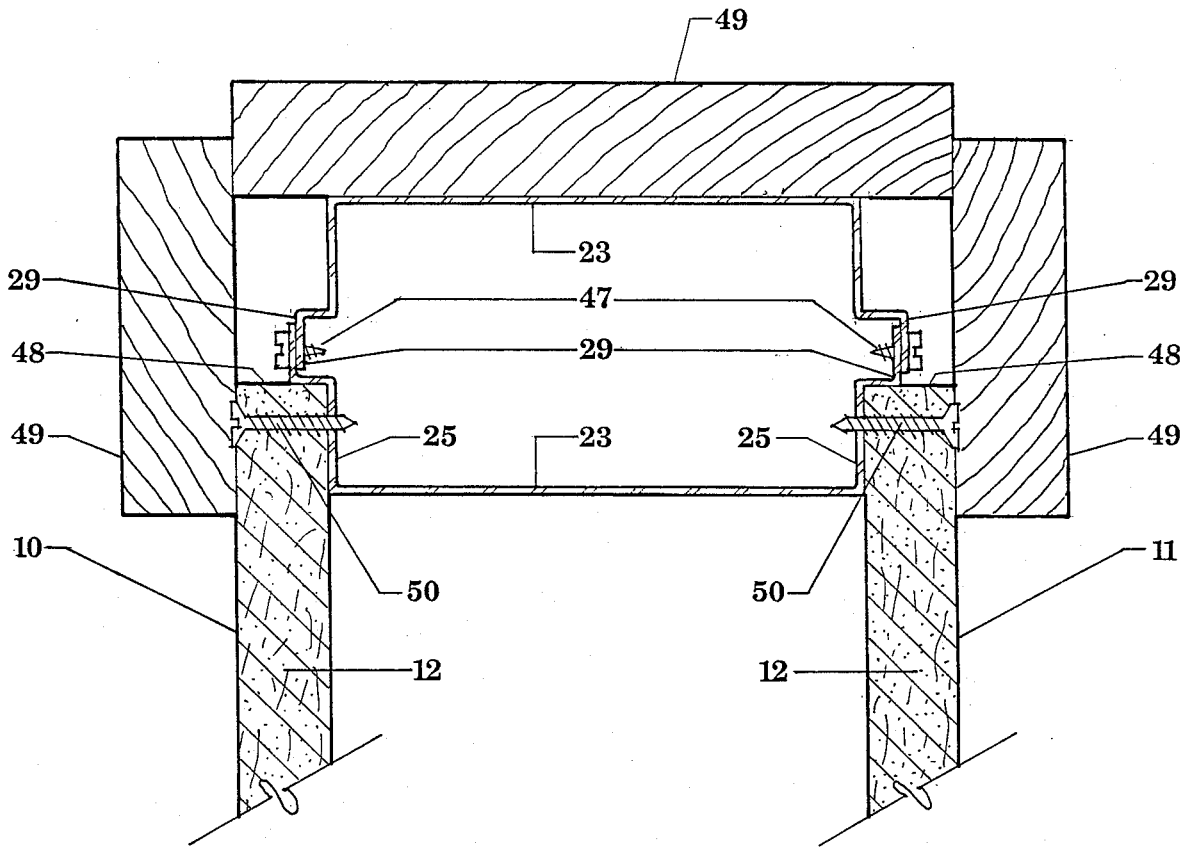
FIG. 13 is a cross-section of a head, still or jamb feature which is illustrative of the method for providing the assemblies of the invention with a termination feature.

An additional novel aspect to the invention relates to a novel wall base structure. Thus, an alternative base detail within the scope of the invention is shown in FIG. 12, which is a partially cutaway perspective sectional view, in which sections of substantially U-shaped upwardly opened floor channels 40, comprising one or more web portions 41 and side portion 42 with side flanges 43 extending perpendicularly from said side portions, are used to support the floor track 17 of FIG. 1. The floor track 17, as previously described, is a section of the support means shown in FIG. 3, which is nested into and attached to floor channels sections 40 and carried by side flanges 43. The dimension across the upwardly projecting flanges of floor track 17 is greater than that across the flanges of vertical support means 23 so as to permit the lower end of the latter to be fitted between and held in place by the flanges of the floor track 17. The floor track 17 co-operatively engages panel members 12 and spline 31 in precisely the same manner as described hereinbefore with respect to the erection of hollow all partitions from the components of the invention, while the use of spaced sections of floor channels 40 permits easy access to the electrical, communications and data processing wiring carried at the base of and within the compartments formed by web partitions 41, these compartments being labeled as 44, 45 and 46 in FIG. 12. The floor channel sections 40 are attached by conventional means to the floor structure 16 and are provided at spaced intervals along the length of the partition to be erected thereon. Ease of access to and manipulation of the electrical, communications and data processing wiring carried within the channel sections, as well as for the receptacles associated with is such wiring, is provided for by the appropriate spacing of the channel sections for a given section of wall. The channel sections and floor track can be covered by baseboard trim members 22. The base detail described above provides a unique aspect to the enclosure assemblies of the invention in that it is specifically adapted for use with the assemblies of the invention while at the same time providing a level of access to utility service distribution equipment not obtainable with existing partition structures. In practical application, leveling for uneven floor surfaces may be accomplished by adjusting the position of floor track 17 up or down within floor channel sections 40, the former being secured to the latter by conventional means, such as screws.

Where the enclosure assembly of the invention reaches the end of a panel run, requiring a termination of that section or module of panel members or where the enclosure assembly must include a door or window frame and the like, the invention is capable of readily accommodating such wall features. FIG. 13 illustrates the manner of terminating the enclosure at a head, sill or jamb. In this Figure, the parallel wall structures 10 and 11 comprised of panels 12 simply require that two support means 23 of the type illustrated in FIG. 3 be mated in such a manner as to create a "boxed" stud structure, where the two support means are attached to each other via screws 47 through the feet 29 of the groove-flange members. The edge of a terminal panel 12 is simply trimmed to size, thereby removing the shouldered groove so as to leave a flat edge 48, which can then be butted against the "boxed" stud structure and carried between side portions 25 of the support means 23 and the door jamb framework 49 or such other detail requiring a termination feature. The panels 12 can also be further secured to side portions 25 by conventional means, such as screws 50.

The system of the invention can be utilized in the construction of ceilings, floors and partial height walls in precisely the same manner as has been described hereinbefore with respect to the construction full height walls. Thus, the system can be used to construct permanent or demountable raised access flooring as well as permanent and demountable ceiling construction.

Because of the ease of erection of enclosure assemblies of the invention, it is possible to have the desired final enclosure assemblies constructed at a variety of sites. Thus, once the components are fabricated, they can be assembled on site in the field, or the components can be pre-assembled at the factory as elements. Moreover, it is fully within the contemplation of the invention that the components can be assembled at a factory into building elements or modules, which can be erected at the ultimate site as partially or totally complete building systems.

It is to be understood that the invention is not to be limited to the exact details of operation or structure shown and described in the specification and drawings, since obvious modifications and equivalents will be readily apparent to those killed in the art.

What is claimed is:

1. A building enclosure assembly comprising, in combination, (a) a plurality of gypsum-based floor, wall or ceiling panel members with a shouldered groove of stepped cross-sectional profile longitudinally rabbeted into at least one edge of said panel member, said shouldered groove comprising two distinct groove sections of distinct depths and widths, wherein a first groove section is of shallower depth and narrower width than a second groove section which is contiguous with the first groove section;

(b) a generally channel-shaped support means having a web portion and side portions with a substantially L-shaped flange member comprising a leg and a foot, extending by said leg from a side portion of said support means and terminating in the foot which is substantially perpendicularly disposed relative to the web portion of the support means; and (c) a fire-resistance spline; where adjacent pairs of said panel members are articulated by the interengagement of said L-shaped flange member and said spline with said shouldered grooves in the edges of adjacent panel members, the foot of said L-shaped flange member nesting into said first groove section and being retained therein by the nesting of a portion of the spline into said second groove section, whereby said spline completely spans over the foot of said L-shaped flange member, and a second panel member is articulated adjacent said first member by the nesting of the remaining portion of said spline into the second groove section in the edge of said second panel member.

2. The building enclosure assembly of claim 1, in which said panel member is composed of gypsum fiber board.

3. The building enclosure assembly of claim 1, in which said fire-resistant spline is composed of gypsum fiber board.

4. The building enclosure assembly of claim 1, in which said shouldered groove of stepped cross-sectional profile is longitudinally rabetted into said panel member edge by mechanical milling.

5. The building enclosure assembly of claim 1, wherein the portion of fire-resistant spline is so nested in the second groove section whose extent of depth is defined by an endwall, that said spline portion completely spans the foot of the L-shaped flange while extending only partially into the second groove section, thereby forming an airspace between said portion of spline and said second groove section endwall.

6. The building enclosure assembly of claim 1, in which said channel-shaped support means has a substantially L-shaped flange member extending from each side portion of said support means.

* * * * *